US009499288B2

(12) United States Patent
Cannon, Jr.

(10) Patent No.: US 9,499,288 B2
(45) Date of Patent: Nov. 22, 2016

(54) METHOD AND APPARATUS FOR VACUUM PACKING RESEALABLE BAGS

(71) Applicant: Thomas Calvin Cannon, Jr., La Plata, MD (US)

(72) Inventor: Thomas Calvin Cannon, Jr., La Plata, MD (US)

( * ) Notice: Subject to any disclaimer, the term of this patent is extended or adjusted under 35 U.S.C. 154(b) by 148 days.

(21) Appl. No.: 14/541,131

(22) Filed: Nov. 13, 2014

(65) Prior Publication Data

US 2016/0137325 A1 May 19, 2016

(51) Int. Cl.
*B65B 31/02* (2006.01)
*B65B 31/04* (2006.01)
*B65D 81/20* (2006.01)

(52) U.S. Cl.
CPC ..... *B65B 31/048* (2013.01); *B65B 31/02* (2013.01); *B65B 31/024* (2013.01); *B65D 81/2038* (2013.01)

(58) Field of Classification Search
CPC ..... B65B 31/00; B65B 31/02; B65B 31/024; B65B 31/04; B65B 31/06; B65B 31/046
See application file for complete search history.

(56) References Cited

U.S. PATENT DOCUMENTS 2,778,171 A * 1/1957 Taunton ..... B65B 31/00 206/524.8
4,756,140 A * 7/1988 Gannon ..... B65B 31/024 53/374.9
4,928,829 A * 5/1990 Di Bernardo ..... B65B 31/06 206/524.8
4,941,310 A * 7/1990 Kristen ..... B65B 31/046 53/434
5,287,680 A * 2/1994 Lau ..... B65B 31/06 53/133.4
5,638,664 A * 6/1997 Levsen ..... B29C 66/0044 53/372.6
5,839,582 A * 11/1998 Strong ..... B65D 33/2566 206/522
5,894,929 A * 4/1999 Kai ..... B65D 81/3461 206/524.8
6,991,109 B1 * 1/2006 Shannon ..... B65B 31/047 206/484
7,021,027 B2 * 4/2006 Higer ..... B65B 31/046 53/434
7,490,452 B2 * 2/2009 Alipour ..... B29C 65/18 53/405
7,887,238 B2 * 2/2011 Turvey ..... B65D 33/01 383/103
8,740,591 B2 * 6/2014 Blythe ..... 417/555.1
8,858,078 B2 * 10/2014 Vonwiller ..... B65D 33/2591 383/100
2003/0024847 A1 * 2/2003 Malaspina ..... B65D 33/01 206/524.8
2004/0177595 A1 * 9/2004 Kozak ..... B65D 81/2023 53/434
2005/0037164 A1 * 2/2005 Wu ..... B31B 41/00 428/34.2
2008/0000204 A1 * 1/2008 Turvey ..... B65B 31/024 53/512

* cited by examiner

*Primary Examiner* — Christopher Harmon

(57) ABSTRACT

The present invention discloses a method and apparatus for closing a resealable vacuum bag while the vacuum bag is still inside the vacuum chamber of a heat-sealing vacuum packing machine. The resealable bag may be automatically closed, at least temporally, by either (1) the compressive forces that vacuum packing machines exert against the sides of vacuum bags, or (2) an autonomous, vacuum-activated device that closes the open section of the vacuum bag's sealing strip. Finally, the cost of the resealable vacuum bag may be minimized by eliminating the air valve that is imbedded in the sides of conventional resealable vacuum bags, but which is superfluous for the present invention.

2 Claims, 6 Drawing Sheets

METHOD AND APPARATUS FOR VACUUM PACKING RESEALABLE BAGS

This invention relates to vacuum packing resealable bags using heat-sealing vacuum packing machines. More particularly, this invention relates to using heat-sealing machines to vacuum pack resealable bags without melting the two sides of plastic bags together to retain the vacuum. The present invention enables resealable bags to be evacuated in heat-sealing machines, removed from the machines, and retain their vacuums, whether or not the bags' sealing strips are completely closed. This innovation allows existing owners of heat-sealing vacuum packing machines to vacuum pack their food in inexpensive resealable bags that do not have air valves in their sides. Since vacuum bags equipped with air valves in their sides are more expensive than similar bags lacking such air valves, the present invention saves users money. Further, existing owners of heat-sealing vacuum packing machines can now satisfy all of their vacuum packing needs with just one system.

The new vacuum packing process disclosed herein takes advantage of the material properties of plastics to retain a temporary vacuum until the sealing strips of plastic bags can be permanently closed. Further, apparatus is disclosed that can permanently close vacuum bag sealing strips while the bags are still inside heat-sealing vacuum packing machines.

BACKGROUND OF THE INVENTION

Vacuum packing foods and refrigerating them helps preserve food freshness, texture, and taste. The two major methods for vacuum packing food bags in the home are using resealable bags, which require mechanical sealing strips to close bags, and heat-sealing machines that melt the sides of bags together. Both methods have their drawbacks. Heat-sealed bags lose a portion of the bag each time they are reentered and resealed. They also require a heat sealer to reclose an opened bag, which may not be available away from home. On the other hand, the mechanical seal of resealable bags adds cost to every bag. Further, most resealable vacuum bags require an air valve imbedded in their sides and special vacuum pumps that mate with the special air valves. These extra features and components not only add costs, but also take up valuable kitchen space. Eliminating the need for air valves, and the associated vacuum pumps or vacuum hoses, would minimize the cost disadvantage of resealable bag. Finally, resealable bags cannot be vacuum packed with heat sealing machines and still be resealable—until now.

If a resealable bag could be vacuum packed with a heat-sealing machine, and still be resealable, than users would only have to buy one type of bag, thereby saving cost and kitchen space. Heat sealing machines work by enclosing the open end of the bag in a small vacuum chamber, drawing air from the bag through via tiny passageways embossed into the plastic sides, and fusing the plastic sides together with a hot wire or tape once the air has been evacuated from the bag. A resealable bag does not naturally lend itself for use with heat-sealing machines the bag's mechanical sealing strip is not accessible during the air evacuation process. Hence, the sealing strip would normally have to be closed after extraction from the heat-sealer. However, doing this would allow some air to reenter the bag no matter how quickly the user closed the sealing strip. Thus to reliably vacuum pack a resealable bag using a heat-sealing vacuum packing machine, some means must be available to close the bags sealing strip, as least for a few seconds, until the user could permanently close the sealing strip once the bag is outside the machine.

The prior art is replete with various bag sealing systems that may be activated either automatically or on command. It is well known that mechanical devices can manipulate food items and vacuum bags while those objects are still inside vacuum chambers. Such manipulations can be performed on a bag's sealing strip. See, for example the patent by Cannon, T (U.S. Pat. No. 7,818,948) that applies a force through the wall of a flexible vacuum chamber to close the vacuum bag's sealing strip. However, most bag manipulation mechanisms are for heat sealing systems and are not designed to close resealable bags. No heat-sealing vacuum packing systems possess mechanisms for closing the sealing strips of resealable bags. Finally, the small size of the vacuum cavities typically found in home vacuum packing machines severely limits the space available for autonomous seal-closing mechanisms. The cross sectional dimensions of the vacuum cavities found in home heat-sealing systems are typically less than 10 mm by 25 mm, making it challenging to devise an economical autonomous seal closing mechanism to fit and operate within such a small space.

Thus there is a need for methods and mechanisms to economically vacuum pack resealable bags using heat-sealing vacuum packing machines.

BRIEF SUMMARY OF THE INVENTION

This invention is a method for reliably and repeatedly exhausting air from a resealable vacuum bag using a heat-sealing vacuum machine. It does this by temporarily closing the open end of the resealable bag while it is still in the heat sealer's vacuum chamber. Prior to inserting the resealable bag in the vacuum chamber, the user creates an air path by closing all but a small segment the bag's mechanical sealing strip, preferably near one end. As the vacuum machine draws air from the food bag, the compliant edges of the machine's vacuum chamber compress the sides of the bag together, thereby plastically deforming the embossed elements in the side of the bag and greatly restricting air flow. Further, the embossed features of the bag become oriented toward flow out of the bag and tend to temporarily resist flow back into the bag. These plastic deformations will persist for a few seconds after the bag is withdrawn from the vacuum chamber. During this period, the user manually closes the small open segment of the sealing strip.

DETAILED DESCRIPTION OF THE INVENTION

The present invention discloses a method and apparatus for closing a resealable vacuum bag while the vacuum bag is still inside the vacuum chamber of a heat-sealing vacuum packing machine. The resealable bag may be closed, at least temporally, by either (1) the compressive forces that vacuum packing machines exert against the sides of vacuum bags, or (2) an autonomous, vacuum-activated device that closes the open section of the vacuum bag's sealing strip. Finally, the cost of the resealable vacuum bag may be minimized by eliminating the air valve that is imbedded in the sides of conventional resealable vacuum bags, but which is superfluous for the present invention.

A key step in the vacuum-packing process disclosed herein is closing all but a small section of the vacuum bag's sealing strip prior to vacuuming. Doing this (1) restricts that area through which air may reenter the bag when it is withdrawn from the vacuum chamber, and (2) makes it easier to completely close the bags seal when acted upon by autonomous devices inside the vacuum cavity. The small open section of the sealing strip is referred to as the air path. The air path is created by pressing the sealing strip together, staring at an end and working toward the other, leaving a small segment of seal open at the far end. Doing this creates a distinctive bulge in the seal, providing definitive separation between mating elements of the sealing strip and allowing air to flow out of the bag when vacuumed.

Figure 1:
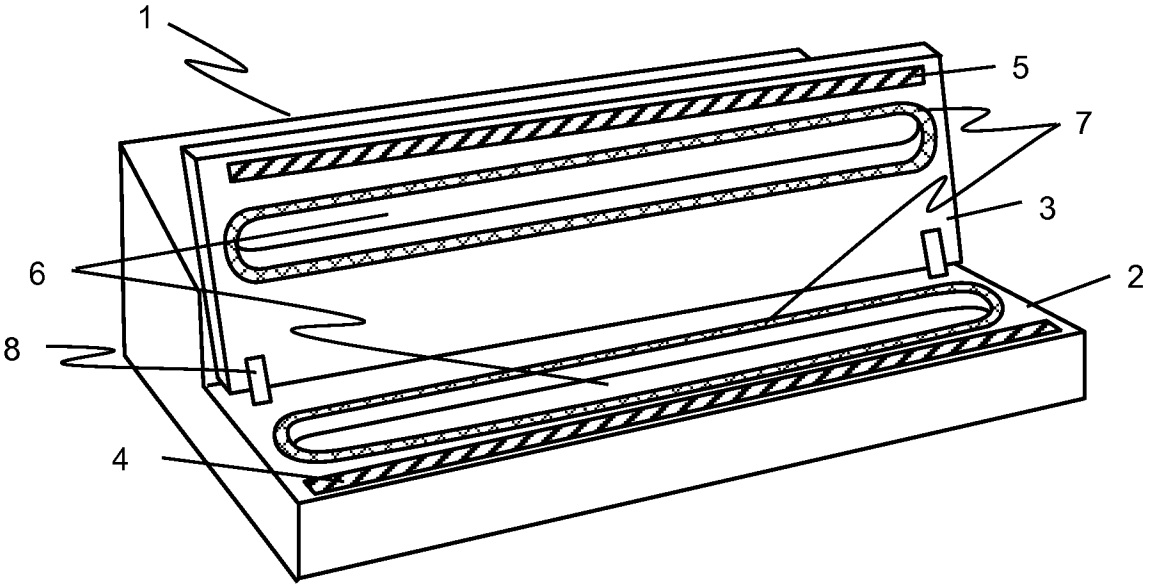
FIG. 1 shows a typical heat sealing vacuum packing machine 1 in the open positions.

FIG. 1 shows a typical heat-sealing vacuum packing machine, 1, and its key components. The heat sealing mechanism consists of a base 2 and a lid 3. The base 2 features a heat sealing strip 4 that together with the Teflon tape 5 sandwiches the sides of vacuum bags and fuses them together at the end of the vacuum packing process. The base 2 also includes the bottom section of the vacuum cavity, 6, that draws air out of vacuum bags. Each half of the vacuum cavity 6 is surrounded by rubber gaskets 7 to form an airtight closure. The base 2 and the lid 3 are held together by hinges 8. Since the vacuum cavity 6 is completely closed during the vacuum packing operation, users lack access to the open ends of bags under vacuum. An important point to note is that heat-sealing vacuum packing machines that use rubber gaskets 7 to form an airtight seal around the mouth of the vacuum bags, only work with vacuum bags having at least one side embossed, or textured, because otherwise the smooth sides of the bag would shut off air flow out of the vacuum bags.

Figure 2B:
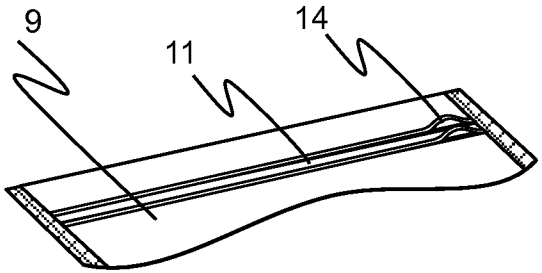
FIG. 2B shows a partially closed resealable bag 9 with a sealing strip 11 firmly closed except for the air path 14.
Figure 2A:
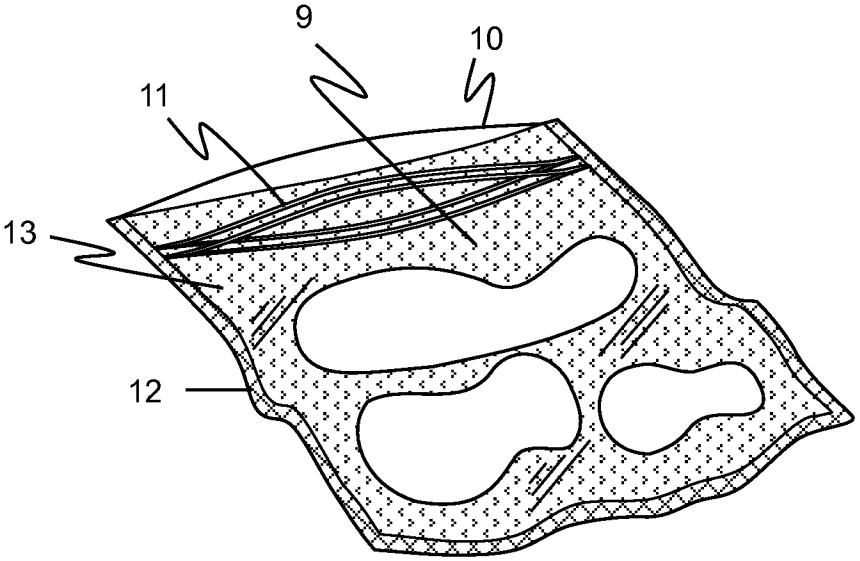
FIG. 2A shows a typical resealable vacuum bag, characterized by embossed peaks and valleys 13 that provide an air path out of the bag during vacuuming. Further, vacuum bags typically have broad sealing surfaces around their closed edges 12.

FIG. 2A shows a typical resealable vacuum bag 9 and its principle features. Two features distinguish resealable vacuum bags 9 from ordinary resealable bags: broad heat-sealed edges 12 and a high quality sealing strip 11. Vacuum bags have broad "surface seals" around their perimeters, versus narrow "line" seals that are prone to leak. Surface seals are made using hot plates while line seals are made with hot knives or hot wires. High quality sealing strips 11 are needed to retain vacuums for extended periods of time, typically months or longer. Users insert their food through the bag mouth 10 and then close the sealing strip 11. Some resealable bags 9 feature air valves (not shown) in their sides to pump out air. Other resealable vacuum bags are evacuated by placing the entire bag inside a vacuum chamber and therefore do not need air valves in their sides. The system disclosed herein works equally well for vacuum bags with and without air valves in their sides. Traditional heat-sealed food vacuum bags are completely open at the start of the vacuum packing process, while traditional resealable food vacuum bags are completely closed.

FIG. 2B shows a partially open resealable bag 9 with a dual track sealing strip 11. In contrast with conventional methods in which the sealing strip is either completely open or completely closed, the vacuum packing method disclosed herein starts with a partially open sealing strip 11. More specifically, the sealing strip 11 is closed in a way to leave a small air path 14 through the sealing strip 11. Such an air path 14 may be easily created by pressing on the sealing strip 11 starting at one end and working toward the other, leaving a short segment open at the far end. Such action causes the top half of the sealing strip 11 to bulge up at the end. It is also possible to create the air path 14 near the middle of the sealing strip but creating it at the end is easier and yields the most consistent results. Optimum results are obtained when the open section of the sealing strip is less than or equal to 0.50 inches, preferably 0.25 inches. In principle, a segment of any length may be left open, but doing so increases the likelihood of some air reentering the bag before the sealing strip 11 is completely reclosed.

The two keys to successfully vacuum packing resealable bags in heat-sealing vacuum machines are (1) withdrawing the bag from the machine prior to the heat-sealing strip self-activating, and (2) retaining a vacuum inside the food bag after withdrawing it from the machine. The former may be achieved by either turning off the heat sealing switch, or unplugging the machine once the desired level of vacuum has been reached. The later may be achieved by one of two automatic processes, or a combination thereof. The first automatic process takes advantage of the finite stress relaxation times of plastic materials and the finite time it takes for air to flow through small passageways. Referring to FIG. 1, the rubber gaskets 7 that surround the vacuum cavity exert sufficiently large forces on the vacuum bag to partially flatten the embossed elements on the side of the vacuum bag, thereby greatly restricting air flow into and out of the vacuum bag during the vacuum packing process. Such plastic deformation persists for a short time after the bag is removed from the vacuum cavity. Also, during the vacuuming process, the outflowing air distorts the bag's embossed elements slightly in the direction of the flow. Such distortions tend to resist air inflow when the vacuum is released. Further, the embossed elements in the area of the bag away from the sealing strip inhibit air flow back into the bag. Fine-grain embossed elements work better than course grain embossed element because the air passage ways around them are smaller. Bags designed to be used in accordance with the present invention should employ fine-grain embossing elements with diameters approximately 0.04 inches or less, and spaced at a density of 20 elements per inch or higher. Finally, referring to FIG. 2B, since the air path 14 is positioned at one end of the seal, air may only flow into the bag through a quarter sector of a circle, versus a half sector were the air path 14 located away from the end. All of the above phenomena, features, and methods combine to help the vacuum bag retain a vacuum for a brief period of time after withdrawal from a vacuum cavity.

Figure 3:
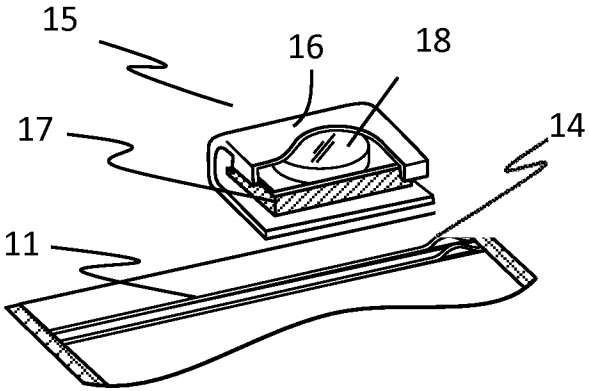
FIG. 3 depicts an automatic vacuum-activated device 15 for closing the sealing strip 11 in a position to be slid over the adjacent air path 14.

A second process involves an autonomous mechanical device to force the air path 14 closed once the desired level of vacuum has been reached in the resealable bag. An embodiment of such an autonomous device, referred to as a seal latch 15 is shown in FIG. 3. The seal latch 15 consists of just three small parts: a U-shaped frame 16 a seal-closing plate 17 and an auto-closing element 18. The vacuum bag's sealing strip 11 fits between the inside surface of the frame 16 and the seal-closing plate 17. The seal-closing plate 17 has a built-in cavity that accepts the auto-closing element 18. The auto-closing element 18 may be a balloon, bellows, or closed cell foam rubber, for example. The auto-expanding element 18 contains some amount of entrapped air that expands when the element is subjected to a vacuum. The seal-closing plate 17 is anchored to the frame 16 and hinged at the anchor points, allowing it to pivot against the air path 14. This expansion drives the seal-closing plate 17 against the air path 14 in the sealing strip 11 forcing it closed. Many other variations of autonomous seal-closing mechanisms designed to operate according to the present invention may be implemented by persons skilled in the art.

Figure 4:
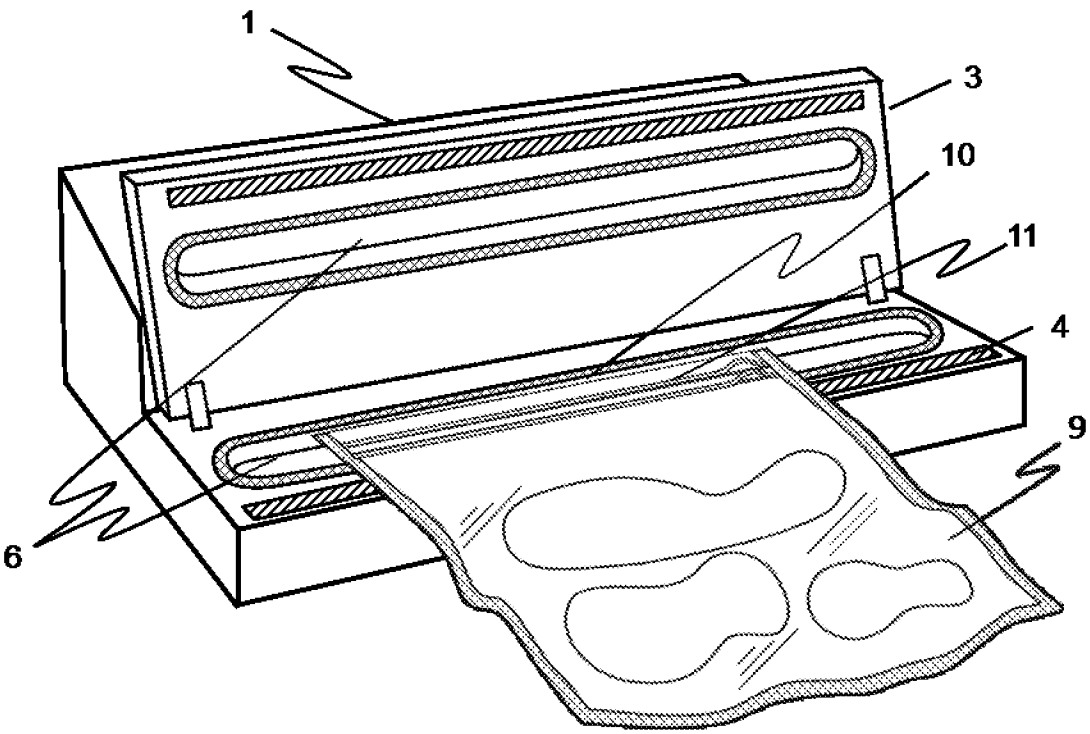
FIG. 4 shows the bag to be vacuumed 9 with its mouth 10 and sealing strip 11 resting inside an open vacuum cavity 6.

FIG. 4 shows the partially closed resealable bag 9 resting across the base 2 of a heat sealing machine 1 in position to be vacuumed. The bag mouth 10 and the sealing strip 11 lay fully inside the vacuum cavity 6.

Figure 5:
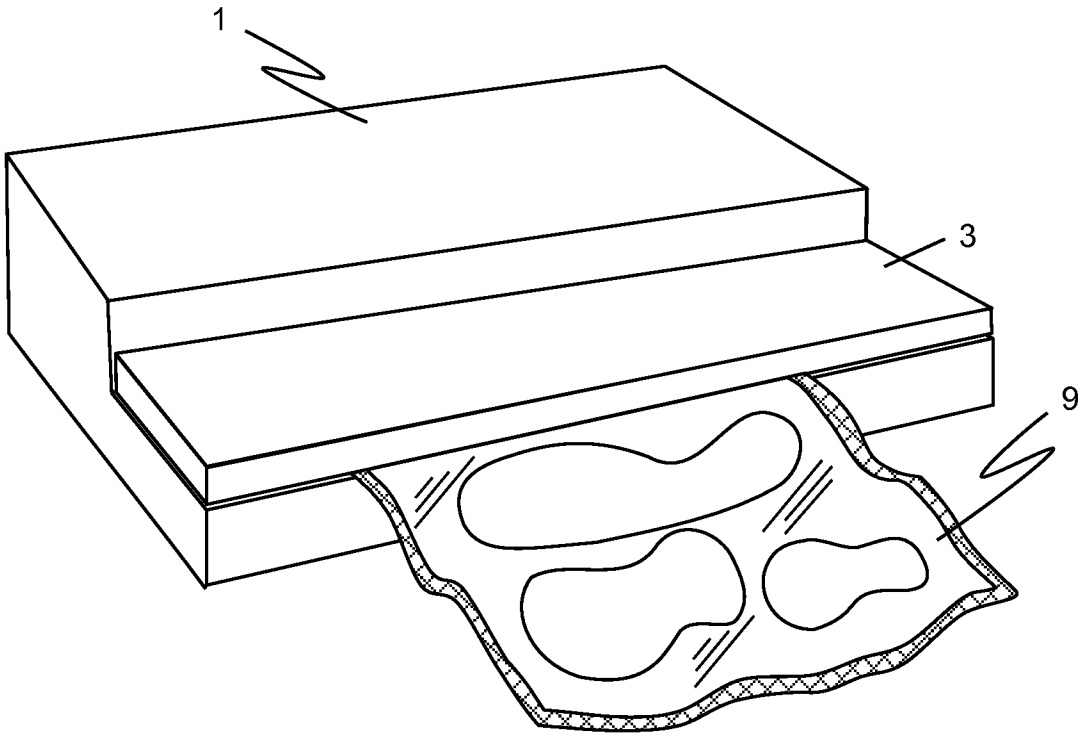
FIG. 5 shows the vacuum bag 9 being vacuumed by a vacuum machine 1.

FIG. 5 shows the closed heat-sealing machine 1 latched onto the closed vacuum bag 9 under vacuum. The vacuum bag 9 is sandwiched between the base 2 and the closed lid 3.

Figure 6:
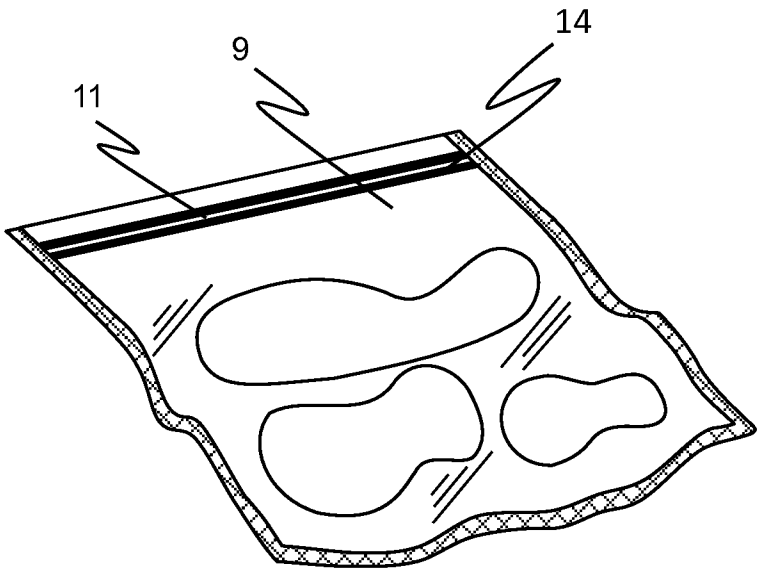
FIG. 6 shows the vacuum packed bag 9 whose air path 14 has been flattened.

FIG. 6 shows the fully evacuated vacuum bag 9 after it has been withdrawn from the vacuum packing machine, and the sealing strip 11 has been manually fully closed. The figure shows the air path 14 in the fully closed and flattened position. Users should close the air path 14 immediately after withdrawing the vacuum packed bag from the vacuum packing machine to minimize air reentry. The first step is to apply pressure directly on the air path, 14. The next step is to apply pressure at the other end of the sealing strip 11 and run a finger along its entire length to ensure that the sealing strip 11 is uniformly tightly closed.

Numerous modifications to and alternative embodiments of the present invention will be apparent to those skilled in the art in view of the foregoing description. Accordingly, this description is to be construed as illustrative only and is for the purpose of teaching those skilled in the art the best modes of carrying out the invention. Details of the system may be varied substantially without departing from the spirit of the invention and the exclusive use of all modifications which come within the scope of the appended claims is reserved.

What I claim as my invention is:

1. A method for evacuating and closing a re-sealable plastic bag comprising:

providing a re-sealable plastic bag possessing an integral mechanical seal wherein the bag requires no other means for sealing the bag;

said bag having at least one side textured to create fine-grain embossed elements having diameters 0.04 inches or less, and spaced at a density of 20 elements per inch or higher, resulting in peaks and valleys that during the vacuuming process distort in ways that permit air to flow out of the bag under a vacuum, yet for a few seconds resist air flowing back into the bag when the vacuum is removed;

closing the entire length of the integral mechanical seal, except a segment defining an air path that leads directly into the bag being no wider than a half inch;

inserting the mouth of the partially open re-sealable bag inside the vacuum cavity of a heat sealing vacuum packing machine;

closing the vacuum cavity and evacuating the bag;

withdrawing the bag mouth from the vacuum cavity;

and manually closing the open segment of the integral mechanical seal thereby sealing the bag.

2. A method for evacuating and closing a re-sealable plastic bag comprising:

providing a re-sealable plastic bag possessing an integral mechanical seal wherein the bag requires no other means for sealing the bag;

said bag having at least one side textured to create fine-grain embossed elements having diameters 0.04 inches or less, and spaced at a density of 20 elements per inch or higher, resulting in peaks and valleys that during the vacuuming process distort in ways that permit air to flow out of the bag under a vacuum, yet for a few seconds resist air flowing back into the bag when the vacuum is removed;

closing the entire length of the integral mechanical seal, except a segment defining an air path that leads directly into the bag being no wider than a half inch;

inserting the mouth of the partially open re-sealable bag inside the vacuum cavity of a heat sealing vacuum packing machine;

closing the vacuum cavity and evacuating the bag;

withdrawing the bag mouth from the vacuum cavity;

and attaching a device to the open segment prior to the bag being inserted into the vacuum cavity of the heat sealing vacuum packaging machine, wherein the device automatically closes the open segment of the integral mechanical seal when subjected to a predetermined vacuum level.

* * * * *